United States Patent [19]

Hörnig

[11] 4,318,878

[45] Mar. 9, 1982

[54] MANUFACTURING METHOD FOR SOAP BARS

[75] Inventor: Hans W. Hörnig, Horb, Fed. Rep. of Germany

[73] Assignee: Blendax-Werke R. Schneider GmbH & Co., Mainz, Fed. Rep. of Germany

[21] Appl. No.: 159,709

[22] Filed: Jun. 16, 1980

[30] Foreign Application Priority Data

Jun. 22, 1979 [DE] Fed. Rep. of Germany ..... 2925228

[51] Int. Cl.[3] ..... C11D 13/08; C11D 13/12; C11D 13/16; C11D 13/18

[52] U.S. Cl. ..... 264/148; 252/90; 252/134; 252/174; 252/368; 252/370; 252/DIG. 16; 264/152; 264/177 R; 264/237; 264/246; 264/247; 264/250; 264/293; 264/320

[58] Field of Search ..... 252/90, 108, 134, 174, 252/367, 368, 370, 371, DIG. 16; 264/177 R, 148, 237, 238, 241, 245, 246, 247, 250, 251, 348, 152

[56] References Cited

U.S. PATENT DOCUMENTS

| | | | |
|---|---|---|---|
| 2,292,359 | 8/1942 | Block | 252/90 |
| 2,412,979 | 12/1946 | Garvey | 264/246 |
| 2,423,435 | 7/1947 | Block | 252/90 |
| 3,294,692 | 12/1966 | Kelly | 252/134 |
| 3,976,736 | 8/1976 | Paris | 264/148 |
| 4,201,743 | 5/1980 | Perla | 264/148 |

*Primary Examiner*—Dennis L. Albrecht
*Attorney, Agent, or Firm*—Bierman & Bierman

[57] ABSTRACT

A process for the production of a compound bar of soap, said bar comprising a primary piece of soap and at least one secondary piece of soap embedded therein, is disclosed. The process comprises (a) extruding the primary piece and each secondary piece at an extrusion temperature, (b) forming at least one cavity in the surface of the primary piece adapted to receive at least one of the secondary pieces, (c) cooling each secondary piece to a cooled temperature, and (d) embedding at least one secondary piece in the cavity. It is a feature of this invention that, under the embedding conditions, the primary piece has a sufficiently low viscosity to permit flow, and the secondary piece has a sufficiently high viscosity to substantially prevent flow.

7 Claims, No Drawings

MANUFACTURING METHOD FOR SOAP BARS

This application claims the priority of German application P 29 25 228.6 filed June 22, 1979.

The present invention is directed to an improvement in the manufacture of a compound bar of soap. This bar is composed of a primary piece into which a secondary piece is embedded or impressed.

Bars of soap having marbled, clear, and even striped appearances have been known for some time. These are very salable because of their unusual appearance, and consumers, particularly children, are very much attracted to them. German Auslegeschrift No. 2,049,268 teaches the production of a bar of soap made up of two halves of different colors. This, too, has achieved substantial popularity with consumers.

Particularly desirable are bars which comprise a small piece of soap which has been embedded in a large piece of soap. The pieces can be of contrasting colors, have particular patterns impressed on them, and permit a wide flexibility in the appearance of the finished bar. These are disclosed in German Offenlegungschriften Nos. 1,617,253 and 1,617,254.

However, there are substantial difficulties in producing such soaps satisfactorily. Commercial processes usually result in deformation of the inserted piece, which ruins the desired esthetic effect. In addition, this same deformation tends to cause unevenness and improper matching after the small piece has been impressed into the large piece. Such a bar is not as attractive as it should be, and much of its appeal is lost for these reasons.

Therefore, it is among the objects of the present invention to produce a bar of soap with a small inlay impressed therein.

it is also among the objects of this invention to produce such a bar of soap wherein the inlay is undistorted and the appearance of the finished bar is attractive.

It is further among the objects of this invention to provide a bar of soap of the type described which can be easily manufactured on a commercial scale by continuous methods.

In achieving the objects of this invention, there is provided a process for the production of a compound bar of soap comprising a primary piece of soap and at least one secondary piece to be embedded therein. The process comprises (1) extruding the primary and secondary pieces, (2) cooling each secondary piece, and (3) embedding each secondary piece in the primary piece. In a preferred form of the invention, a cavity is formed in the surface of the primary piece, and the secondary piece is then embedded therein.

It is a feature of this invention that the viscosities of the primary and secondary pieces under the embedding conditions must be controlled so that the primary piece has a sufficiently low viscosity to permit flow during embedding, while the secondary piece has a sufficiently high viscosity to substantially prevent flow during embedding. The primary contemplated method of controlling the viscosities is by controlling the temperatures at which the embedding takes place. It has been found that the extrusion temperature is advantageously in the range of 35° C. to 45° C., and the cooled temperature is advantageously in the range of 25° C. to 35° C. Most preferably, these temperatures are about 40° C. and 30° C., respectively. respectively.

If the foregoing parameters are observed, the flowing of the primary piece of soap firmly encloses the secondary piece, while the firmness of the latter prevents any distortion thereof. As a result, a firm bond is obtained, and the insert is neat and undistorted.

In commercial operation, the primary and secondary pieces can be extruded in parallel, as in an extrusion press. Vacuum type double-worm extrusion presses, which are well known in the art, have been found suitable for this purpose.

In a preferred form of the invention, the secondary piece is cut to the desired size subsequent to extrusion and the cooling. The desired cavity is advantageously stamped into the primary piece and the secondary piece is embedded therein. The resulting bar can be shaped, stamped, or otherwise treated in various ways known to those of ordinary skill in the art.

The composition of the soap used in the present invention may vary widely. Of course, the usual alkali metal salts of higher fatty acids are suitable. In addition, however, surfactant "soaps" may also be used. The usual additives including, but not limited to, perfumes, dyes, emollients, etc. may also be included. A good description of such compositions may be found in *Ullmanns Enzyklopadie der technischen Chemie,* 3rd Edition, Volume 18, pages 355 to 395 (1967, Urban & Schwarzenberg, Munich-Berlin-Vienna) and in the monograph by D. Osteroth, "Kosmetikum Feinseife" (1972, Huthig-Verlag, Heidelberg).

While only a limited number of embodiments of the present invention have been expressly disclosed, such modifications as would be apparent to the person of ordinary skill in the art may be made without departing from the scope or spirit thereof. For example, it is clear that a plurality of secondary pieces may be embedded in a single primary piece, or even in a single cavity. The shape of either piece may be varied widely, although a conical secondary piece and a complementary cavity in the primary piece have been found particularly useful.

In order to provide yet another interesting and attractive variation on the present invention, the cavity may be stamped with a desired pattern prior to the insertion of the secondary piece therein. Thus, as the soap is used, the pattern will emerge. Bars of soap of this kind are described in copending U.S. Application No. 49,093, filed June 18, 1978.

While certain types of equipment have been specifically set forth, these may be replaced by equivalent devices such as are known in the field. Moreover, depending upon the particular composition of the soap used, the actual temperatures may vary from those set forth herein. It is important to the proper practice of this invention that the secondary piece be substantially solid and non-flowable under embedding conditions, while the primary piece flows under the same conditins.

The foregoing modifications are intended to be illustrative only, and the present invention is to be broadly construed and not to be limited except by the character of the claims appended hereto.

What is claimed is :

1. A process for the production of a compound bar of soap, said bar comprising a primary piece of soap and at least one secondary piece of soap embedded therein, said process comprising (a) extruding said primary piece and each said secondary piece at an extrusion temperature of 35° to 45° C., (b) cooling each said secondary piece below said extrusion temperature to a cooled temperature of 25° to 35° C., (c) forming a cavity in the surface of said primary piece prior to said embedding adapted to receive at least one said secondary piece, (d) stamping a pattern in the bottom of said cavity, (e) embedding each said secondary piece in a cavity, said primary piece having a viscosity low enough to permit flow during embedding, and said secondary piece having a viscosity high enough to substantially prevent flow during embedding.

2. The process according to claim 1 wherein said extrusion temperature is about 40° C.

3. The process according to claim 1 wherein said cooled temperature is about 30° C.

4. The process according to claim 1 wherein said primary piece and each said secondary piece are extruded side-by-side and parallel to each other.

5. The process according to claim 1 wherein said secondary piece is cut to predetermined size and shape.

6. The process according to claim 1 wherein said cavity is formed by stamping.

7. The process according to claim 1 wherein said cooling takes place abruptly.

* * * * *